United States Patent [19]

Domke

[11] Patent Number: 4,690,667

[45] Date of Patent: Sep. 1, 1987

[54] METHOD FOR PRODUCING A PACKAGING CONTAINER HAVING A PRESSURE RELIEF VALVE

[75] Inventor: Klaus Domke, Ditzingen, Fed. Rep. of Germany

[73] Assignee: Robert Bosch GmbH, Stuttgart, Fed. Rep. of Germany

[21] Appl. No.: 853,505

[22] Filed: Apr. 18, 1986

[30] Foreign Application Priority Data

Jul. 25, 1985 [DE] Fed. Rep. of Germany ..... 3526602

[51] Int. Cl.[4] ..... B31B 1/14; B31B 1/90

[52] U.S. Cl. ..... 493/213; 493/63; 493/87; 493/148; 493/220; 383/103

[58] Field of Search ..... 493/63, 87, 148, 213, 493/220; 53/128; 220/205; 383/103

[56] References Cited

U.S. PATENT DOCUMENTS

| | | | |
|---|---|---|---|
| Re. 32,018 | 11/1985 | Domke et al. | 53/480 |
| 2,092,445 | 9/1937 | Dougheridis | 53/404 |
| 3,198,419 | 8/1965 | Canno | 493/220 |
| 4,000,846 | 1/1977 | Gilbert | 383/103 |
| 4,134,535 | 1/1979 | Barthels et al. | 220/205 |
| 4,290,253 | 9/1981 | Domke et al. | 53/480 |
| 4,533,425 | 8/1985 | Wehle | 493/302 |

FOREIGN PATENT DOCUMENTS

| | | |
|---|---|---|
| 0012874 | 4/1982 | European Pat. Off. . |
| 3147321 | 2/1985 | Fed. Rep. of Germany . |

*Primary Examiner*—Frederick R. Schmidt
*Assistant Examiner*—William E. Terrell
*Attorney, Agent, or Firm*—Edwin E. Greigg

[57] ABSTRACT

A method for producing a packaging container having a pressure relief valve that is tightly secured to the inside of the packaging container and closes off an opening in the wall of the packaging container. To seal off the pressure relief valve, a fluid sealant is introduced into the valve, after the valve has been secured to the packaging container. To this end, an opening is punched by a hollow needle into the wall of the packaging container in the area coinciding with the pressure relief valve, and through the hollow needle a droplet of sealant is deposited in the peripheral zone of a membrane of the pressure relief valve. By capillary action, the sealant enters into the gap between a carrier part and the membrane of the valve and becomes distributed over this area.

7 Claims, 2 Drawing Figures

METHOD FOR PRODUCING A PACKAGING CONTAINER HAVING A PRESSURE RELIEF VALVE

BACKGROUND OF THE INVENTION

The invention is based on a method for producing a packaging container having a pressure relief valve as set forth herein. In a known method of this kind, disclosed in German Offenlegungsschrift No. 31 47 321, for instance, the pressure relief valve is first assembled from its individual parts, with a sealant, such as silicone oil, being added at the same time. Next, this valve is placed so as to coincide with a opening through which gas can flow that has been punched out beforehand from a strip of packaging container material, and the peripheral flange of the valve is heat-sealed to the inside of the packaging material. In practice, pressure relief valves of this type are manufactured in great quantities, separately from the packaging containers, and are then gathered and brought to a packaging machine in bundles containing a large number of valves; there, they are separated again and then heat-sealed to a pack aging container, or to a strip of packaging material from which packaging containers are then made. Experience has shown again and again that when pressure relief valves of this kind, equipped with a fluid sealant, are transported, or while the already assembled pressure relief valves are in storage, small quantities or traces of the sealant get into the area of the peripheral flange of the valves and into the area of their heat-sealing faces. As a result, when the valves are heat-sealed to the thermoplastic inner layer of the packaging container, portions of the heat-sealing face of the securing flange that are moistened with sealant fail to undergo proper sealing, because the silicone oil used as a sealant acts like an insulating film to inhibit heat-sealing. Such interruptions in the sealed seam between the valve and the packaging container are not gas-tight, allowing air to enter, and oxygen from the air damages the oxygen-sensitive product contained in the package.

European Pat. No. A 12874 also discloses a method for sealing off a pressure relief valve for a packaging container. In this method, fluid sealant is deposited on the edge of the sealing membrane after the individual parts of the valve have been assembled. By capillary action, the viscous sealant then enters in between the membrane and the carrier element, preventing gas diffusion between these parts.

OBJECT AND SUMMARY OF THE INVENTION

The method according to the invention has the advantage over the prior art that no traces of the sealant can get into the vicinity of the heat-sealing seam, because the sealant is not introduced into the valve until a pressure relief valve is being secured to a packaging container, or thereafter, or else is introduced prior to the container's being formed from the packaging material. It is also particularly advantageous that because the sealant is introduced from outside the package, particles of sealant cannot get into the inside of the package and come into contact with the product.

By using a hollow needle as a punching tool, the sealant can be introduced at the same time the opening is made. This has the advantage that it is possible both to make the opening that the valve seals off and to add the sealant in a single operation.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
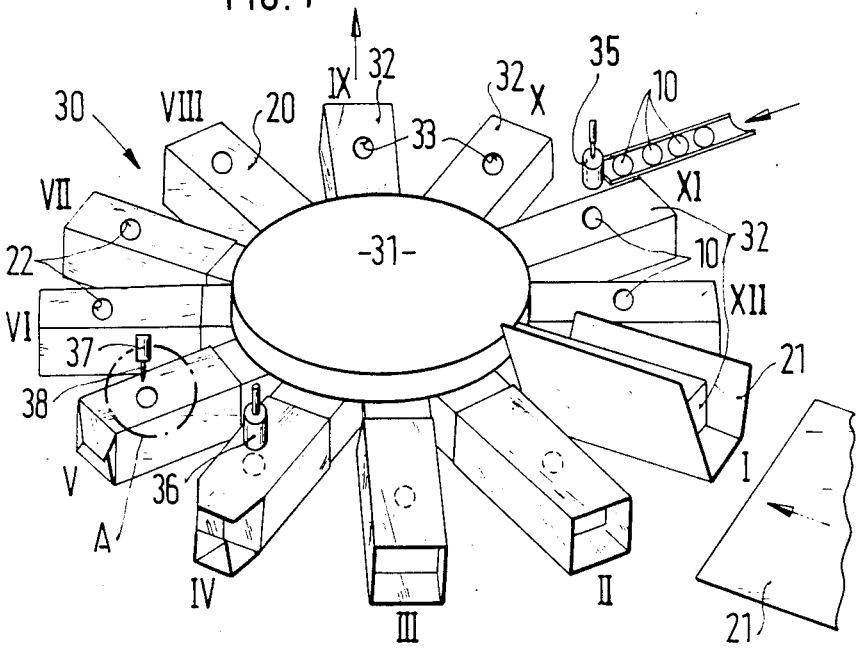
FIG. 1 is a simplified perspective view of an exemplary embodiment for performing the method according to the invention, in the form of an apparatus for producing packaging bags having a pressure relief valve.
Figure 2:
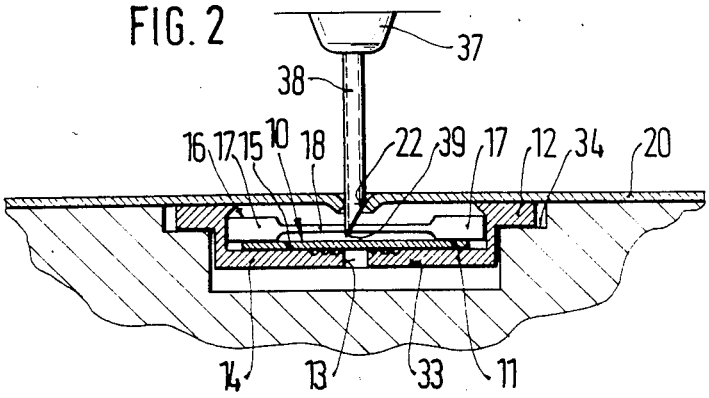
FIG. 2 is a cross-sectional view, on a larger scale, of a detail indicated at A in FIG. 1.

With the method according to the invention, pressure relief valves for packaging containers such as those described in German Offenlegungsschrift No. 31 47 321 can be sealed off with a fluid sealant, the valves being produced separately from the packaging containers and only later joined to them. These valves 10 comprise a flat carrier plate 11 having an outer peripheral flange 12 and a central opening 13 in a bottom part 14. In the indentation of the carrier plate 11, a membrane 15 rests on the bottom part 14 and covers the opening 13. The membrane 15 is pressed firmly against the bottom part 14 in two zones opposite one another by a clamping element 16, so that the central zone of the membrane can lift up from the bottom part. The clamping element 16 has two jaws 17, which are joined by a web 18. Instead of being secured with a clamping element 16, the membrane 15 can also be firmly joined to the bottom part 14 by layers of adhesive in the vicinity of the two peripheral zones opposite one another.

A valve 10 of this kind, which eliminates excess pressure, is secured on the inside of a packaging container, in particular a packaging bag 20 made of a flexible substantially gas impermeable packaging material having a thermoplastic inner layer. This is preferably done by heat-sealing the peripheral flange 12 of the carrier plate 11 to the thermoplastic inner layer of the packaging bag 20. However, it is also possible to attach the valve 10 by adhesive means; to that end, a layer of adhesive is applied to the peripheral flange 12.

Attaching the valve 10 to the packaging bag 20 is preferably done when the packaging container is made. However, it can also be done prior to the forming of the packaging container 20 on the strip of packaging material intended for that purpose, or on a blank 21 of packaging material. In the exemplary embodiment of a bag making apparatus 30 shown in FIG. 1, which has a plurality of radially offstanding forming mandrels 32 on a wheel 31 that is rotated in increments, one blank 21 is wrapped in sleeve-like fashion about one of the mandrels 32 an a station I each time the wheel 31 is moved by one increment. At the following stations II–VIII, first the longitudinal seam and then the bottom of the packaging bag 20 is formed in a manner known per se and tightly fused or heat-sealed. At a station IX, the finished empty bag is pulled off the forming mandrel 32 and conveyed further for filling and closure.

For bringing a pressure relief valve 10 and a packaging bag 20 together, the forming mandrels 32 have a recess 33 in their top that is adapted to the outer shape of the carrier plate 11 of the valves 10 and in which the carrier plate 11 rests with its peripheral flange 12 on a shoulder 34. At station XI, one valve 10 at a time is placed by a suction plunger 35 in the recess 33 of the forming mandrel 32 that is in readiness. At station IV, this valve 10, covered by the upper wall of the packaging bag 20 that has been formed from the blank 21, is tightly heat-sealed with its peripheral flange 12 to the inside of this upper wall with the aid of a heat-sealing plunger 36. To produce an opening 22 in the wall of the packaging bag 20 that coincides with the valve 10, a punching tool 37 is provided at station V. This punching tool 37 has a hollow needle 38; while the forming mandrels 32 are stopped, this hollow needle 38 is moved from above against the upper wall of the packaging bag 20, so that the beveled tip 39 of the hollow needle 38 punches completely through the packaging material and plunges into the indentation in the carrier plate 11. The punching tool 37 is arranged with respect to the recesses 33 of the forming mandrels 32 such that the punching of the opening 22 takes place beside the web 18 of the clamping element 16, as close as possible to the periphery of the indentation in the carrier plate 11 and to the periphery of the membrane 15 that thas been placed therein. After the opening has been punched into the wall of the packaging bag 20, a small quantity of a fluid sealant, such as silicon oil, is deposited through the hollow needle 38 in the peripheral region of the membrane 15. By capillary action, the fluid sealant enters into the very narrow gap between the carrier plate 11 and the membrane 15, between the firmly clamped peripheral zones. For metering out the quantity of sealant, a microdosing device is associated with the punching tool 37; after each punching of an opening 22, the microdosing device supplies a small quantity of sealant under pressure to the hollow needle 38.

After the retraction of the hollow needle 38, the droplet of sealant deposited in the peripheral zone of the membrane 15 runs, and by capillary action the majority of it enters into the narrow gap between the membrane 15 and the adjoining side of the carrier plate 11, between the peripheral zones that are firmly clamped by the two jaws 17. The film of sealant that is formed prevents the diffusion of gas or air through this gap, so that the valve is very tight. The packaging bag 20 thus manufactured and equipped with a pressure relief valve 10 is pulled off the forming mandrel 20 at station IX and is sent to be filled and closed.

Introducing the sealant fluid into the pressure relief valve after the valve has been secured on the packaging container has the advantage not only that soiling of the heat-sealed zone of the valve with sealant is prevented, thereby precluding leaks between the valve and the packaging container, but also that the valve becomes functional only shortly before the packaging container is filled, so that its function is unimpaired by the evaporation of sealant that might occur during storage. The use of a hollow needle offers the further advantage that an opening can be provided on the packaging bag and sealant can be introduced into the valve, all in the same operation.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A method for securing and forming a pressure release valve onto a packaging bag by use of a bag making apparatus which comprises:

forming a pressure release valve including a carrier having an inner bottom surface and a peripheral flange and including a central opening in the inner bottom surface;

said forming step including positioning a membrane on said inner bottom surface of the carrier and over the central opening and securing the membrane in the carrier at oppositely disposed surface areas, positioning the pressure release valve in a recess of a support with the peripheral flange of the release valve supporting the carrier within said recess with the membrane above said inner bottom surface, positioning a substantially gas impermeable packaging material to which the relief valve is to be secured over the carrier supported in the recess of the support, securing the peripheral flange of the carrier to the packaging material, and forming an opening through which gas can flow in the packaging material which coincides with the confines of the peripheral flange of said release valve and injecting a quantity of sealant through the formed opening onto said membrane which seals between said membrane and said carrier.

2. A method as set forth in claim 1 in which the opening is formed by forcing a hollow punch through the packaging material.

3. A method as set forth in claim 2 in which the quantity of sealant is injected through said hollow punch to a peripheral zone of the membrane.

4. A method as set forth in claim 1 in which the peripheral flange is secured to the packaging material by use of an adhesive.

5. A method as set forth in claim 1 in which said peripheral flange is secured to the packaging material by applying heat to the packaging material in the vicinity of the peripheral flange.

6. A method as defined by claim 1 in which said membrane is secured to said carrier at oppositely disposed areas by an adhesive.

7. A method as defined by claim 1 in which said membrane is secured in said carrier by use of a clamping element.

* * * * *